US009420675B2

(12) United States Patent
Otterberg

(10) Patent No.: US 9,420,675 B2
(45) Date of Patent: Aug. 16, 2016

(54) DRIVER CIRCUIT FOR A FLASH TUBE

(71) Applicant: PROFOTO AB, Sundbyberg (SE)

(72) Inventor: Anders Otterberg, Ekerö (SE)

(73) Assignee: PROFOTO AB, Sundbyberg (SE)

( * ) Notice: Subject to any disclaimer, the term of this patent is extended or adjusted under 35 U.S.C. 154(b) by 0 days.

(21) Appl. No.: 14/766,965

(22) PCT Filed: Feb. 11, 2014

(86) PCT No.: PCT/SE2014/050166
§ 371 (c)(1),
(2) Date: Aug. 10, 2015

(87) PCT Pub. No.: WO2014/126528
PCT Pub. Date: Aug. 21, 2014

(65) Prior Publication Data

US 2015/0373818 A1 Dec. 24, 2015

(30) Foreign Application Priority Data

Feb. 13, 2013 (SE) ..... 1350168

(51) Int. Cl.
*H05B 41/32* (2006.01)
*H05B 41/36* (2006.01)

(52) U.S. Cl.
CPC ..... *H05B 41/32* (2013.01); *H05B 41/36* (2013.01)

(58) Field of Classification Search
CPC ..... H05B 41/30; H05B 41/32; H05B 41/34; H05B 41/36; H05B 41/28; H05B 41/2828; H05B 41/2928; H05B 37/0281; H05B 41/325; H05B 33/0815; H05B 33/0818; H05B 33/0803; G03B 15/05; G05B 15/03
USPC ..... 315/241 P, 240, 241 R, 243, 246, 247, 315/291, 307, 360, 209 R, 200 A; 396/164
See application file for complete search history.

(56) References Cited

U.S. PATENT DOCUMENTS 4,107,706 A * 8/1978 Ueda ..... G03B 7/16 362/4
5,678,077 A 10/1997 Ichikawa et al.
7,030,573 B2 * 4/2006 Powell ..... H05B 41/34 315/291
7,274,155 B2 * 9/2007 Inochkin ..... H05B 41/34 315/246
7,859,194 B2 * 12/2010 Walker ..... H05B 41/325 315/209 R (Continued)

OTHER PUBLICATIONS

Office Action issued Sep. 27, 2013 in Swedish application No. 1350168-9.

*Primary Examiner* — Haissa Philogene
(74) *Attorney, Agent, or Firm* — Knobbe, Martens, Olson & Bear

(57) ABSTRACT

The present invention relates to a driver circuit for a flash tube. The driver circuit comprises a first and a second output for an electronic flash tube, a capacitor, an inductor and a switch. The inductor and the switch being connected in series with the first and a second output across the capacitor. A component which only allows current flow in one direction connected across the first and the second output and the inductor, with a polarity opposite to a direction of energy supply from the capacitor to the first output. The driver circuit further comprises a controller for controlling the switch. The controller comprises receiving means for receiving parameters related to desired flash characteristics. The controller being configured to control said switch based on said parameters to obtain said desired flash characteristics.

8 Claims, 5 Drawing Sheets

(56) References Cited

U.S. PATENT DOCUMENTS

| | | | | |
|---|---|---|---|---|
| 8,933,728 | B2 * | 1/2015 | Deppe | H02J 7/345 323/271 |
| 2004/0085026 | A1 | 5/2004 | Inochkin et al. | |
| 2011/0029046 | A1 | 2/2011 | Fisher | |
| 2012/0112658 | A1 * | 5/2012 | Hauser | H05B 41/325 315/294 |
| 2013/0230305 | A1 * | 9/2013 | Falk | G01J 3/505 396/164 |

* cited by examiner $$T_{des} \Rightarrow E = \begin{cases} E_1 \text{ or } E_2 \text{ or } E_3 \text{ or} \\ E_1+E_2 \text{ or } E_2+E_3 \text{ or } E_1+E_3 \text{ or} \\ E_1+E_2+E_3 \end{cases}$$

DRIVER CIRCUIT FOR A FLASH TUBE

CROSS-REFERENCE TO RELATED APPLICATIONS

This application is the U.S. National Phase under 35. U.S.C. §371 of International Application PCT/SE2014/050166, filed Feb. 11, 2014, which claims priority to Swedish Patent Application No. 1350168-9, filed Feb. 13, 2013. The disclosures of the above-described applications are hereby incorporated by reference in their entirety.

TECHNICAL FIELD

The invention relates in general to a driver circuit for a flash tube.

BACKGROUND

Generally, in driver circuits for flash tubes, it is desirable to control the amount of energy provided to a flash tube connected to the driver circuit as well as the color temperature of the resulting emitted light from the flash tube.

A driver circuit typically comprises at capacitor C configured to feed energy to a flash tube for a flash. The flash tube discharge by igniting ignition circuits inside the flash tube and thus drains the capacitor C. A first method of controlling the amount of energy provided to a flash tube and the color temperature of the emitted light from the flash tube is illustrated in FIGS. 1A-1B. In FIG. 1A, by charging the capacitor C up to a particular charging voltage, an amount of energy corresponding to the energy level $E_C$ is stored in the capacitor C. When said amount of energy $E_C$ is provided to the flash tube, the resulting emitted light from the flash tube will have the desired color temperature $T_{des}$. If the capacitor C is instead charged up to a lower charging voltage, a lower amount of energy corresponding to the energy level $E_{des}$ is stored in the capacitor C. Thus, when said lower amount of energy $E_{des}$ is provided to the flash device, the resulting emitted light from the flash device will instead have the color temperature $T_B$. However, it may often be desirable to achieve the desired color temperature $T_{des}$ of the resulting emitted light from the flash device, but while only providing the amount of energy $E_{des}$ to the flash device.

In FIG. 1B, the capacitor C is charged to a particular charging voltage V corresponding to an amount of energy $E_{des}$+E'. As the amount of energy in the capacitor C is drained by the flash device, the discharge of energy is interrupted at time $t_1$ when the amount of already discharged energy by the flash device corresponds to the desired amount of energy $E_{des}$. This will result in that the remaining amount of energy E' is cut off and not discharged by the flash device. Consequently, the emitted light from the flash tube will have the color temperature $T_1$. According to the inherent relationships shown in FIG. 1B, a particular charging voltage V and a discharge interruption timing $t_1$ can be found such that the amount of energy provided to the flash tube is $E_{des}$ and the color temperature $T_1$ is approximately the same as $T_{des}$, i.e. $T_1 \approx T_{des}$. Thus, in case of using a flash tube, it is in this manner possible to provide a desired amount of energy $E_{des}$ to the flash tube and still achieve the desired color temperature $T_{des}$ of the resulting emitted light, as shown by the arrow in FIG. 1A.

A second method of controlling the amount of energy provided to a flash tube and the color temperature of the emitted light from the flash tube is to have a set or bank of different capacitors, e.g. $C_1$-$C_3$, which are configured to provide energy to the flash tube for the flash. This is illustrated in FIGS. 2A-2B. A given capacitor, e.g. $C_3$, of a particular capacitance being charged to a particular charging voltage $V_3$ corresponding to an energy level $E_3$ will generate a particular color temperature $T_{des}$ of the emitted light when provided to a flash device at a flash tube. Here, if a different amount of energy is desired to be provided to the flash tube for the flash, while keeping the color temperature $T_{des}$ of the emitted light, any one of the different capacitors $C_1$-$C_3$ may be used separately or be combined to provide the desired amount of energy. However, since the number of capacitors sources $C_1$-$C_3$ in the set is finite due to the inherent implementation and economic considerations of having a large amount of capacitors, only finite number of discrete energy levels, e.g. $E_1$, $E_2$, $E_3$, $E_1+E_2$, $E_1+E_3$, $E_2+E_3$, $E_1+E_2+E_3$, will be possible for the desired color temperature $T_{des}$.

However, both of the methods described above suffer from disadvantages. For example, by using the first method described above in reference to FIGS. 1A-1B, the amount of energy $E_C$ has to be lowered in order for the flash tube to get a desired color temperature. Another disadvantage with the first method is that the circuits used to interrupt the current have difficulties handle high currents.

Furthermore, achieving according to the second method a desired color temperature $T_{des}$ for a continuous, non-discrete range of energy levels E for even a flash device is not a scalable or cost efficient solution.

There is therefore a need for an improved solution for achieving a desired color temperature $T_{des}$, which solution solves or at least mitigates at least one of the above mentioned problems.

SUMMARY

It is understood by the inventor that it is highly desirable to provide a driver circuit for a flash tube capable of providing a desired energy to a flash tube and that the flash tube also emits a desired color temperature during the flash time.

This issue is addressed by a driver circuit for a flash tube. The driver circuit comprises a first and a second output for a flash tube, a capacitor, an inductor and a switch. The inductor and the switch being connected in series with the first and a second output across the capacitor. A component which only allows current flow in one direction connected across the first and the second output and the inductor, with a polarity opposite to a direction of energy supply from the capacitor to the first output. The driver circuit further comprises a controller for controlling the switch. The controller comprises receiving means for receiving parameters related to desired flash characteristics. The controller being configured to control said switch based on said parameters to obtain said desired flash characteristics.

Since the driver circuit comprises receiving means for receiving parameters related to desired flash characteristics and the controller controls the switch based on the received parameters it is possible to obtain the desired flash characteristics from a flash tube connected to the driver circuit. This is a highly desirable feature of a flash device from a photographer's point of view since it enables a more predictable and reliable flash when taking a photograph.

Another advantage of the driver circuit is that it provides the option to individually control different parameters related to the desired flash characteristics. In an exemplary embodiment of the driver circuit it is therefore possible to individually control the color temperature, the flash energy or the flash time. This is an advantage if the photographer wants to only change one characteristic of the flash and keep another characteristic constant.

A further advantage of the driver circuit is that it provides more options, since it allows a photographer to control characteristics of the flash individually.

Yet another advantage of the driver circuit is that for different capacitor voltages, the colour temperature and flash energy can be kept constant, controlled by the duty cycle. Therefore several flashes with the same colour temperature can be fired independent of capacitor charging in between, as long as sufficient energy is stored in the capacitors.

Yet a further advantage of the driver circuit is that when the flash energy is changed, the voltage of the flash capacitors need not be changed before the flash is fired to get a desired colour temperature, as long as sufficient energy is stored in the capacitors.

BRIEF DESCRIPTION OF THE DRAWINGS

The objects, advantages and effects as well as features of the invention will be more readily understood from the following detailed description of exemplary embodiments of the invention when read together with the accompanying drawings, in which.

DETAILED DESCRIPTION

Figure 1A:
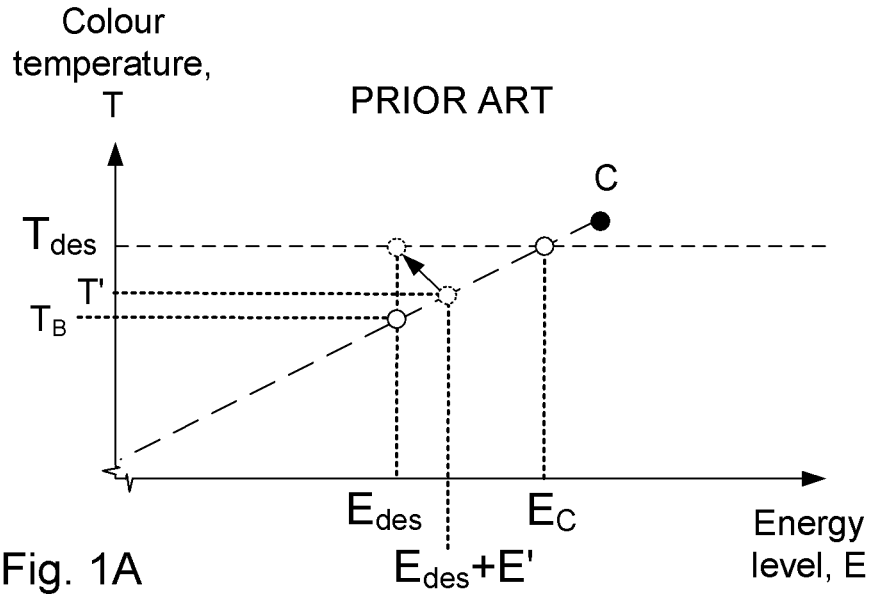
FIGS. 1A and 1B shows schematic graphs illustrating a first method of controlling the amount of energy provided to and the color temperature of the emitted light from a single flash device according to a prior art example.
Figure 1B:
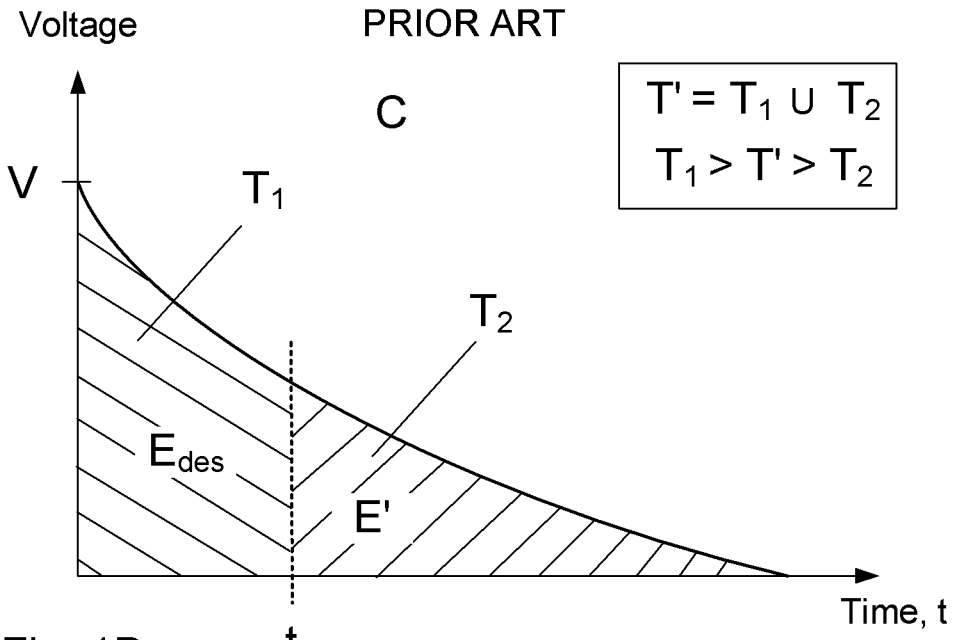
Figure 2A:
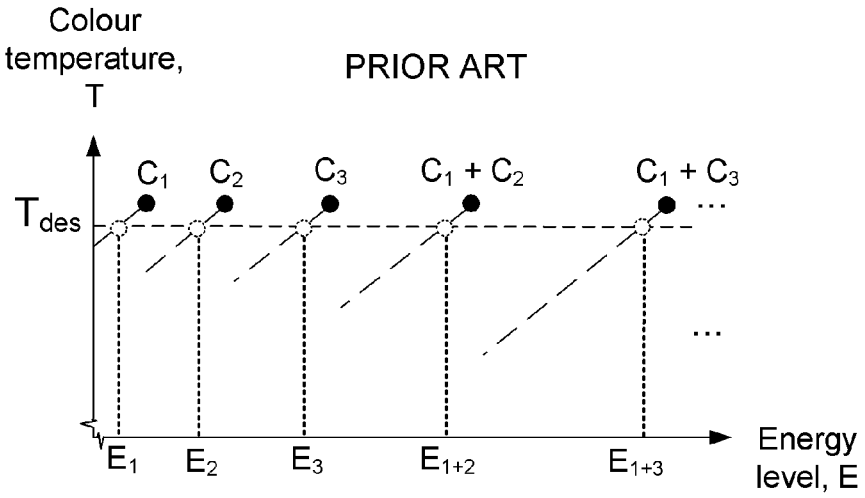
FIGS. 2A and 2B shows schematic graphs illustrating a second method of controlling the amount of energy provided to and the color temperature of the emitted light from a single flash device according to a prior art example.
Figure 2B:
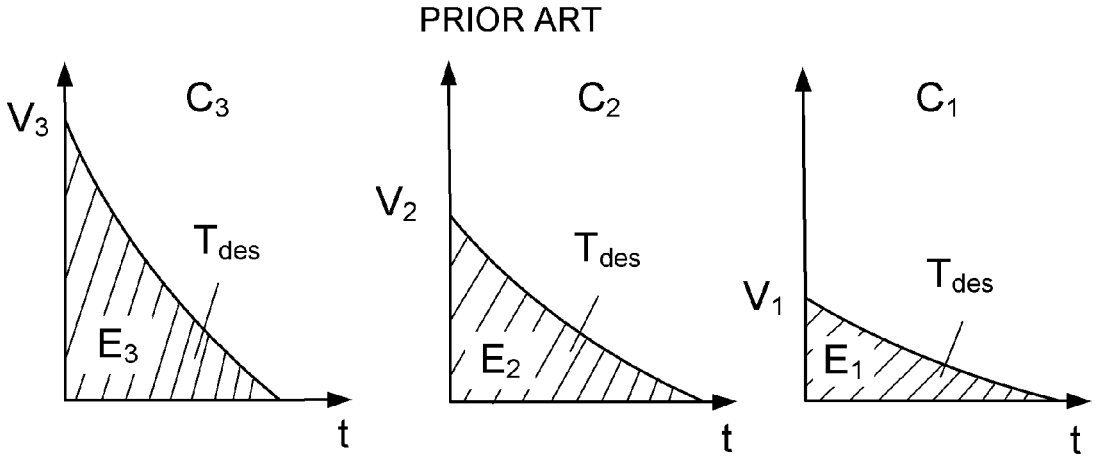

The present invention will be described more fully hereinafter with reference to the accompanying drawings, in which preferred embodiments of the invention are shown. The invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like reference signs refer to like elements.

Figure 3:
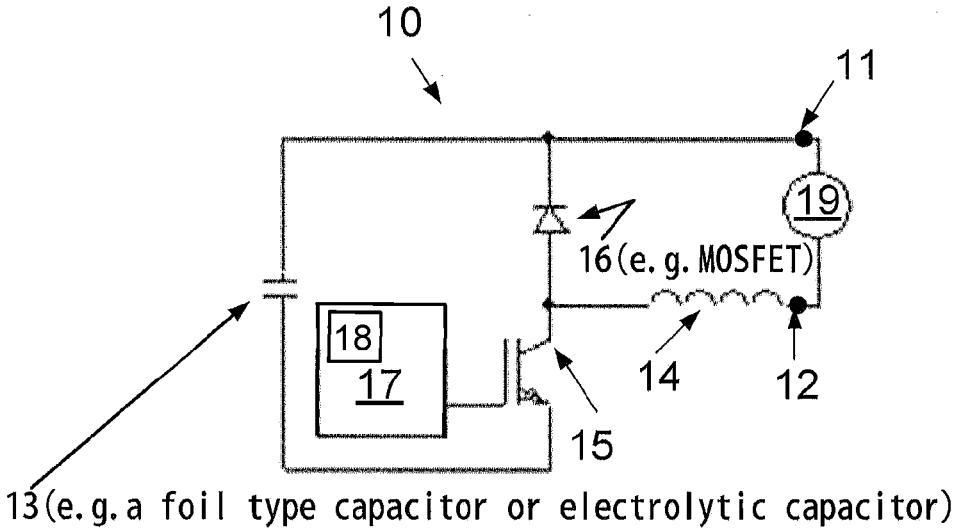
FIG. 3 illustrates a schematic block diagram of a driver circuit according to an exemplary embodiment of the invention.

FIG. 3 illustrates a driver circuit 10 for a flash tube 19 according to an exemplary embodiment of the present invention. The driver circuit 10 may be used in a flash generator (not shown) or in a flash device (not shown). Other types of devices with a flash tube in the device or connected to the device can also use the driver circuit 10 according to the exemplary embodiments of the present invention. An example of another device is a camera with a built in flash tube. The driver circuit 10 comprises a capacitor 13, an inductor 14 and a switch 15. The inductor 14 and the switch 15 being connected in series with the first 11 and the second output 12 across the capacitor 13. Further, a component 16 which only allows current flow in one direction is connected across the first 11 and the second output 12 and the inductor 14, with a polarity opposite to a direction of energy supply from the capacitor 13 to the first output 11.

The capacitor 13 can also be of different types. The capacitor 13 can be a foil type capacitor or an electrolytic type capacitor 13. Different types of capacitors 13 have different internal resistant. Foil type capacitors have low internal resistance compared to electrolytic type capacitors. Therefore it is possible to discharge a foil type capacitor 13 faster and thus generate a higher current density and a higher color temperature compared with an electrolytic type capacitor 13.

In the exemplary embodiment illustrated in FIG. 3 only one capacitor 13, one inductor 14, one switch 15 and one diode 16 are illustrated. Other exemplary embodiments of the driver circuit 10 according to the present invention the driver comprise several capacitors 13, inductors 15, diodes 16 and switches 15. In theses exemplary embodiments are the capacitors 13 connected in parallel with each other. Having several capacitors 13 connected in parallel give the capacitors 13 a higher capacitance which make is possible to store more energy compared to using only one capacitor 13. Capacitors 13 connected in parallel in other exemplary embodiments can also be of different types. A first capacitor 13 can be a foil type capacitor and the second type of capacitor 13 can be an electrolytic type capacitor 13. Different types of capacitors 13 have different internal resistant. Foil type capacitors have low internal resistance compared to electrolytic type capacitors. Therefore the discharge of a foil type capacitor will go faster and generate a higher current density and a higher color temperature compared with an electrolytic type capacitors. By mixing capacitors of different types, another flash energy and another color temperature can be achieved from a flash tube connected to the driver circuit 10 compared to if only one type of capacitor were used.

In these exemplary embodiments with capacitors of different types connected in parallel the capacitors can also be used individually. Using e.g. only a foil type of capacitor provides a shorter flash time compared to using an electrolytic type of capacitor of the same size.

As mentioned above other exemplary embodiments than the embodiment illustrated in FIG. 3 can also comprise several inductors 14 and switches 15. In these exemplary embodiments the inductors 14 are connected in parallel. Using several inductors 14 in parallel give the advantage that the driver circuit 10 can handle higher currents compared to if only one inductor 14 is used. Several inductors 13 in parallel also change the inductance. The switches 15 also are connected in parallel in the exemplary embodiments containing more than one switch 15.

In one exemplary embodiment of the driver circuit 10 according to the present invention is the component 16 a diode 16. The diode 16 is then connected with a polarity opposite to a direction of energy supply from the capacitor 13 to the first output 11. In another exemplary embodiment of the driver circuit 10 according to the invention the component 16 is a MOSFET, Metal Oxide Semiconductor Field Effect Transistor, connected to a controller 17, and wherein the controller 17 is configured to control the MOSFET so that the MOSFET does not conduct current when the switch 15 conducts current. The controller 17 is further configured for controlling the switch 15, as will be described below.

The controller 17 can comprises receiving means 18 for receive parameters related to characteristics for a desired flash. These parameters are then used by the controller 17 when determining how to control the switch 15 in order to produce a flash with the desired characteristics according to the parameters received by the receiving means 18. In one exemplary embodiment the receiving means 18 receives a desired color temperature, a desired flash time and a desired flash energy. In other exemplary embodiments the receiving means 18 is configured to receive other parameters that describe characteristics for a flash. These parameters can be e.g. one of or a combination of a desired color temperature, a flash energy and/or flash time. The parameters are then used by the controller 17 to control the switch 15 so that the flash tube 19 connected to the drive circuit 10 produces a flash with the desired flash characteristics.

In yet another exemplary embodiment the receiving means 18 also receives information about what type of flash tube 19 that is connected to the driver circuit 10. In this exemplary embodiment the controller 17 is further configured to use this information when determining how to control a flash tube connected to the driver circuit.

In an exemplary embodiment of the driver circuit 10 the controller 17 is further configured to switch the switch 15 on and off in repetitive duty cycles in order to produce a flash with the characteristics according to the parameters received by the receiving means 18.

Figure 4:
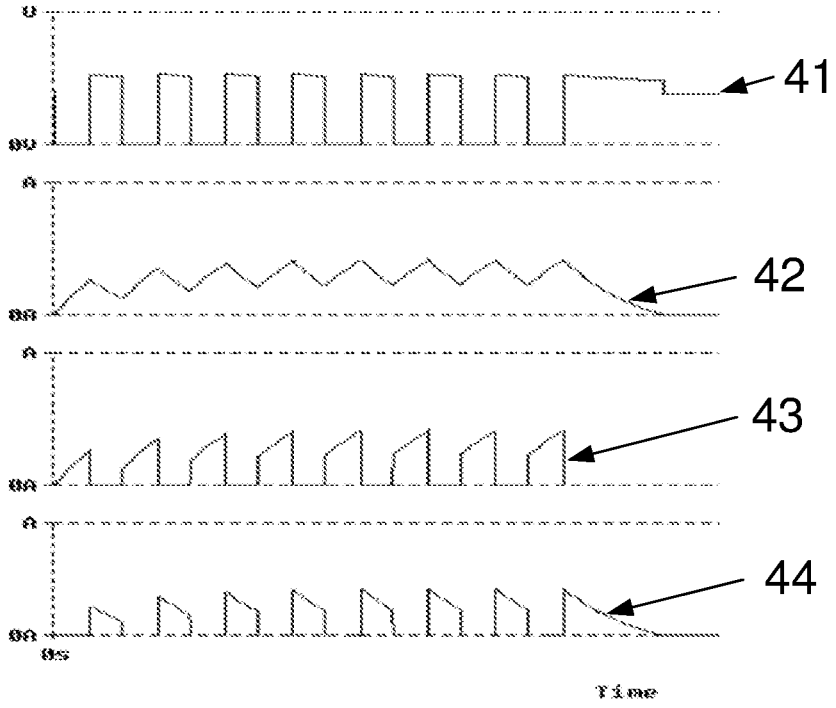
FIG. 4 illustrates several diagrams 41-44 of different currents and voltages in the driver circuit 10 when the switch 15 is switched on and off in repetitive duty cycles when the duty cycle in FIG. 4 is 50%.

FIG. 4 illustrates several diagrams 41-44 of different currents and voltages in the driver circuit 10 when the switch 15 is switched on and off in repetitive duty cycles during the flash time. The duty cycle in FIG. 4 is 50%. The first diagram 41 illustrates the voltage over the switch 15 when the switch 15 is turned on and off by the controller 15. As can be seen in diagram 41 the voltage over the switch 15 is approximately zero when the switch 15 is on when the switch 15 is off the voltage over the switch is approximately the same as over the capacitor 13, except for a small voltage drop over the component 16. The next diagram 42 illustrates the current through the first 11 and the second output 12 when the switch 15 is switched on and off. This is also the current that passed through the flash tube 19 connected to the driver circuit 10. As can been seen in diagram 42 the current first raises to a certain level when the switch 15 first is turned on. The current falls and rises periodically with the duty cycle. The color temperature from the flash tube is dependent on the current through the flash tube connected to the driver circuit 10. A higher current leads to a higher color from the flash tube and a lower current leads to a lower current from the flash tube. The color temperature will therefore vary with the rise and fall of the current through the flash tube. This variation is however small in comparison with the current level through the flash tube, the current variation will therefore have small impact on the color temperature. Diagram 43 illustrates the current through the switch 15. As can be seen the current varies with the duty cycle for the switch 15. When the switch 15 is an on state the current rises and when the switch 15 is an off state the current is zero. Next, in diagram 44 is the current through the component 16 which only allows current flow in one direction illustrated. The current through the component 16 which only allows current flow in one direction varies with the duty cycle for the switch 15. When the switch 15 is closed the inductive energy that has been built up in the inductor 14 makes the current go through the component 16 which only allows current flow in one direction instead for through the switch 15.

Figure 5:
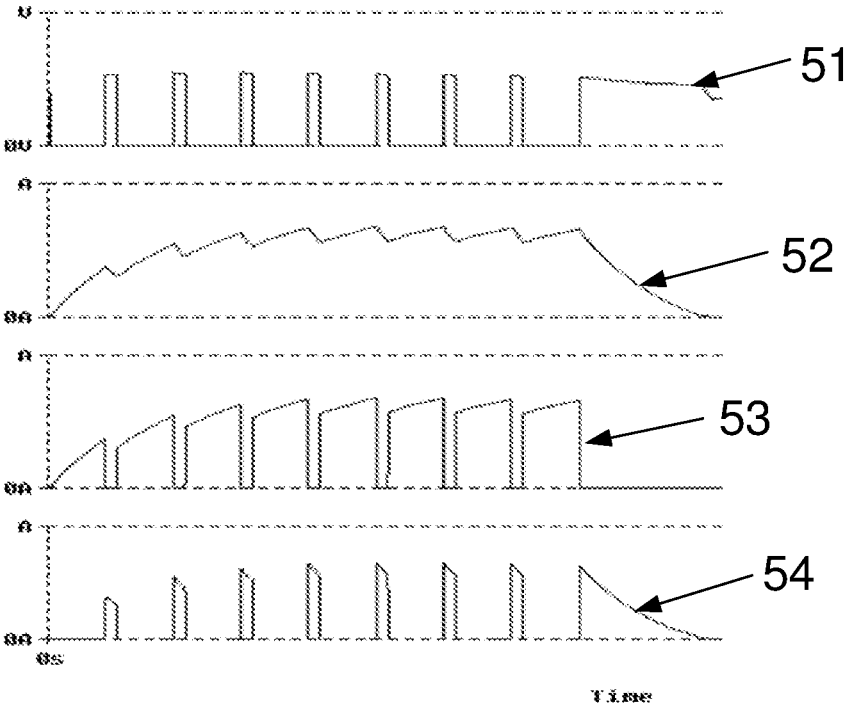
FIG. 5 illustrates several diagrams 51-54 of different currents and voltages in the driver circuit 10 when the switch 15 is switched on and off in repetitive duty cycles when the duty cycle in FIG. 5 is 80%.
Figure 6:
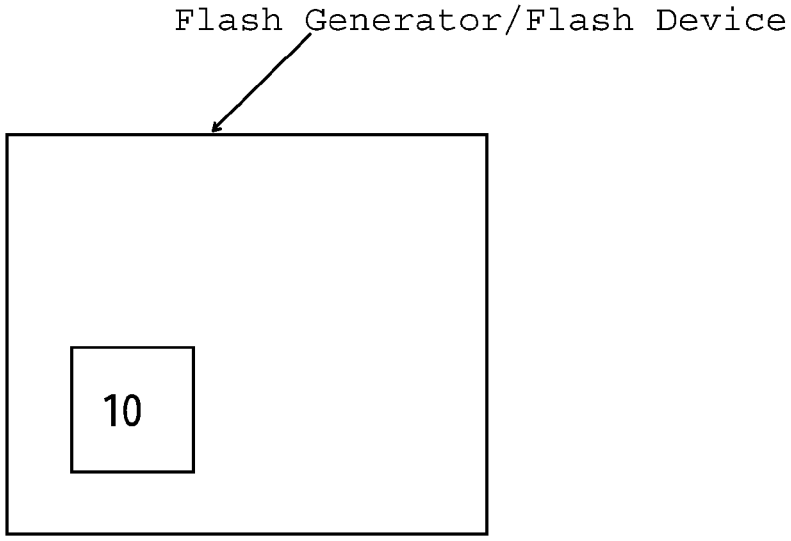
FIG. 6 illustrates a schematic block diagram of a flash generator/flash device according to the embodiment of the invention

FIG. 5 illustrates several diagrams 51-54 of different currents and voltages in the driver circuit 10 when the switch 15 is switched on and off in repetitive duty cycles during the flash time. The duty cycle in FIG. 5 is 80%. The first diagram 51 illustrates the voltage over the switch 15 when the switch 15 is turned on and off by the controller 15. As can be seen in diagram 51 the voltage over the switch 15 is approximately zero when the switch 15 conducts current. When the witch 15 is closed the voltage over the switch is approximately the same as over the capacitor 13, except for a small voltage drop over the component 16. The next diagram 52 illustrates the current through the first 11 and the second output 12 when the switch 15 is switched on and off. This is also the current that passed through the flash tube 19 connected to the driver circuit 10. As can been seen in diagram 52 the current first raises to a certain level when the switch 15 first is turned on. The current falls and rises periodically with the duty cycle. The color temperature from the flash tube follows the current through the flash tube connected to the driver circuit 10. A higher current leads to a higher color from the flash tube and a lower current lead to a lower current from the flash tube. The color temperature will therefore vary with the rise and fall of the current through the flash tube. This variation is however small in comparison with the current level through the flash tube, the current variation will therefore have small impact on the color temperature. Diagram 53 illustrates the current through the switch 15. As can be seen the current varies with the duty cycle for the switch 15. When the switch 15 is an on state the current rises and when the switch 15 is an off state the current is zero. Next, in diagram 54 is the current through the component 16 which only allows current flow in one direction illustrated. The current through the component 16 varies with the duty cycle for the switch 15. When the switch 15 is open the inductive energy that has been built up in the inductor 14 makes the current go through the component 16 instead for through the switch 15.

In the exemplary embodiment of the driver circuit 10 illustrated in FIG. 3 the controller 17 is further configured to increase the duty cycle to achieve a higher color temperature and to decrease the duty cycle to achieve lower color temperature. Increasing the duty cycle for the switch 15 imply that the switch 15 will be open during a longer period of the duty cycle and thereby will the current through a flash tube connected to the driver circuit 10 increase. A higher current through the flash tube results in a higher color temperature.

The driver circuit 10 according to the exemplary embodiment is further configured to increase the flash time if the same energy level is desired at a lower color temperature. If the duty cycle is reduced the color temperature from a flash tube connected to the driver circuit 10 is lowered. Thereby is also the power level from the flash tube connected to the driver circuit 10 lowered. In order to compensate for this lower power level the controller 17 in this exemplary embodiment is configured to increase the flash time.

In another exemplary embodiment the driver circuit 10 is further configured to change the duty cycle during the desired flash time, thereby obtaining different color temperatures during the flash time. In a first period of the flash time the controller may use a first duty cycle and then change to another duty cycle for the rest of the flash time. Using different duty cycles during the flash time results in that the color temperature will vary during the flash time. A longer duty cycle can e.g. be used in the beginning of the flash time than in the end of the flash time. This will result in that color temperature will fall during the flash time.

In yet another exemplary embodiment of the driver circuit 10 for different capacitor voltages, the color temperature and flash energy can be kept constant, controlled by the duty cycle. Therefore several flashes with the same color temperature can be fired independent of capacitor charging in between, as long as sufficient energy is stored in the capacitors. In this exemplary embodiment of the driver circuit, when the flash energy is changed, the voltage of the flash capacitors need not be changed before the flash is fired to get a desired color temperature, as long as sufficient energy is stored in the capacitors.

The description above is of the best mode presently contemplated for practicing the present invention. The description is not intended to be taken in a limiting sense, but is made merely for the purpose of describing the general principles of the invention. The scope of the present invention should only be ascertained with reference to the issued claims.

What is claimed is:

1. A driver circuit for a flash tube comprising:

a first and a second output for an electronic flash tube;

a capacitor;

an inductor;

a switch;

said inductor and said switch being connected in series with said first and said second output across said capacitor;

a component which only allows current flow in one direction connected across said first and said second output and said inductor, with a polarity opposite to a direction of energy supply from said capacitor to said first output;

a controller for controlling said switch, said controller comprising receiving means for receiving parameters related to desired flash characteristics, said parameters comprising a desired color temperature, a desired flash time and a flash energy, and said controller being configured to control said switch based on said parameters to obtain said desired flash characteristics wherein said controller is further configured to:

switch said switch on and off in repetitive duty cycles during said flash time, increase the duty cycles to achieve a higher color temperature and to decrease the duty cycles to achieve lower color temperature, and increase the flash time if the same energy level is desired at a lower color temperature and to decrease the flash time if the same energy level is desired at a higher color temperature.

2. The driver circuit for a flash tube according to claim 1, wherein said capacitor is an electrolytic type capacitor.

3. The driver circuit for a flash tube according to claim 1, wherein said capacitor is a foil type capacitor.

4. A flash generator comprising a driver circuit according to claim 1.

5. A flash device comprising a driver circuit according to claim 1.

6. The driver circuit for a flash tube according to claim 1, wherein said controller is further configured to change said duty cycles during said desired flash time, thereby obtaining different color temperatures during said flash time.

7. The driver circuit for a flash tube according to claim 1, wherein said component which only allows current flow in one direction is a diode.

8. The driver circuit for a flash tube according to claim 1, wherein said component which only allows current flow in one direction is a MOSFET, Metal Oxide Semiconductor Field Effect Transistor, connected to said controller, and wherein said controller is further configured to control said MOSFET so that said MOSFET is off when said switch is on.

* * * * *